US010167067B2

(12) United States Patent
Suzuki et al.

(10) Patent No.: US 10,167,067 B2
(45) Date of Patent: Jan. 1, 2019

(54) VESSEL PROPULSION APPARATUS AND VESSEL INCLUDING THE SAME

(71) Applicant: YAMAHA HATSUDOKI KABUSHIKI KAISHA, Iwata-shi, Shizuoka (JP)

(72) Inventors: Takayoshi Suzuki, Shizuoka (JP); Kohei Yamaguchi, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 0 days.

(21) Appl. No.: 15/810,236

(22) Filed: Nov. 13, 2017

(65) Prior Publication Data

US 2018/0134355 A1 May 17, 2018

(30) Foreign Application Priority Data

Nov. 14, 2016 (JP) ..... 2016-221861

(51) Int. Cl.

| | |
|---|---|
| ***B63H 1/16*** | (2006.01) |
| ***B63H 23/24*** | (2006.01) |
| ***B63H 21/21*** | (2006.01) |
| ***B63H 21/17*** | (2006.01) |
| ***B63H 25/42*** | (2006.01) |
| ***B63H 23/32*** | (2006.01) |

(52) U.S. Cl.

CPC ..... *B63H 1/16* (2013.01); *B63H 21/17* (2013.01); *B63H 21/21* (2013.01); *B63H 21/213* (2013.01); *B63H 23/24* (2013.01); *B63H 23/326* (2013.01); *B63H 25/42* (2013.01); *B63H 2001/165* (2013.01); *B63H 2021/216* (2013.01)

(58) Field of Classification Search

CPC . B63H 5/10; B63H 5/125; B63H 5/14; B63H 5/15; B63H 20/32; B63H 20/34; B63H 21/17; B63H 21/21; B63H 21/213; B63H 21/22; B63H 23/06; B63H 23/24; B63H 23/34; B63H 1/16; B63H 25/42

USPC ..... 440/1

See application file for complete search history.

(56) References Cited

U.S. PATENT DOCUMENTS

| | | | |
|---|---|---|---|
| 2013/0115833 | A1 | 5/2013 | Suzuki et al. |
| 2016/0090166 | A1 | 3/2016 | Suzuki et al. |
| 2016/0185431 | A1 | 6/2016 | Suzuki et al. |

FOREIGN PATENT DOCUMENTS

| | | | |
|---|---|---|---|
| CA | 2 723 800 | A1 | 11/2009 |
| DE | 10 2008 023 050 | A1 | 11/2009 |
| EP | 2 143 632 | A2 | 1/2010 |

(Continued)

*Primary Examiner* — Lars A Olson

(74) *Attorney, Agent, or Firm* — Keating and Bennett, LLP

(57) ABSTRACT

A vessel propulsion apparatus includes a cylindrical duct including a stator and a propeller. The propeller includes a rim including a rotor disposed at a position facing the stator and defining an electric motor in combination with the stator, and blades on an inner side in a radial direction of the rim. A fluid bearing is provided on the duct and defines a gap into which surrounding water is introduced between the fluid bearing and the rim, and is water-lubricated with respect to the rim due to water introduced into the gap from the surroundings. The vessel propulsion apparatus further includes a motor controller that drives the electric motor by rotation speed control in a rotation speed control region in which an output command is not more than a predetermined value, and drives the electric motor by torque control in a torque control region in which an output command is more than the predetermined value.

6 Claims, 7 Drawing Sheets

(56) References Cited

FOREIGN PATENT DOCUMENTS

| | | | |
|---|---|---|---|
| JP | 2013-100013 | A | 5/2013 |
| JP | 2016-068610 | A | 5/2016 |

VESSEL PROPULSION APPARATUS AND VESSEL INCLUDING THE SAME

CROSS REFERENCE TO RELATED APPLICATIONS

This application claims the benefit of priority to Japanese Patent Application No. 2016-221861 filed on Nov. 14, 2016. The entire contents of this application are hereby incorporated herein by reference.

BACKGROUND OF THE INVENTION

1. Field of the Invention

The present invention relates to a vessel propulsion apparatus that generates a propulsive force by using an electric motor as a drive source, and a vessel including the same.

2. Description of the Related Arts

United States Patent Application Publication No. 2016/0185431 A1 discloses an electric propulsion unit including a cylindrical duct that functions as a stator and a rim that functions as a rotor rotatable relative to the duct. The rim includes a plurality of blades inside. The stator and the rotor constitute an electric motor. By driving this electric motor, the rim rotates, and blades provided in the rim generate a propulsive force.

A recess is defined annularly on an inner circumferential surface of the duct, and in this recess, a fluid bearing is disposed. The rim is supported rotatably by the fluid bearing.

SUMMARY OF THE INVENTION

The inventors of preferred embodiments of the present invention described and claimed in the present application conducted an extensive study and research regarding a vessel propulsion apparatus, such as the one described above, and in doing so, discovered and first recognized new unique challenges and previously unrecognized possibilities for improvements as described in greater detail below.

Between the fluid bearing and the rim, a gap is defined. Due to surrounding water entering this gap, water lubrication between the fluid bearing and the rim is obtained.

However, when the rim rotates at a low speed, the water flow in the gap between the fluid bearing and the rim is insufficient, so that sufficient water lubrication cannot be obtained, and the fluid bearing and the rim come into frictional contact with each other. Accordingly, the rim cannot be sufficiently rotated, and it is difficult to generate a desired propulsive force.

Preferred embodiments of the present invention provide vessel propulsion apparatuses that solve the above-described problem and vessels including the same.

In order to overcome the previously unrecognized and unsolved challenges described above, a preferred embodiment of the present invention provides a vessel propulsion apparatus including a cylindrical duct including a stator, a propeller including a rim that includes a rotor facing the stator and defining an electric motor in combination with the stator, and a blade on an inner side in a radial direction of the rim, a fluid bearing that is provided on the duct, defines a gap into which surrounding water is introduced between the fluid bearing and the rim, and is water-lubricated with respect to the rim due to water introduced into the gap from the surroundings, and a motor controller that drives the electric motor by rotation speed control in a rotation speed control region in which an output command is not more than a predetermined value, and drives the electric motor by torque control in a torque control region in which the output command is more than the predetermined value.

With this arrangement, by driving the electric motor with an electric current supplied to the stator, the rim rotates together with the rotor. Accordingly, the blade on the inner side in the radial direction of the rim paddles surrounding water, and a propulsive force is thus generated. A gap is defined between the fluid bearing provided on the duct and the rim. Due to water introduced into the gap from the surroundings, water lubrication between the rim and the fluid bearing is obtained. Therefore, the rim is supported rotatably by an inexpensive arrangement.

When the rotation speed of the rim, that is, the rotation speed of the propeller is low, the water flow inside the gap between the fluid bearing and the rim is not sufficient, so that the rim may come into frictional contact with the liquid bearing. Due to this, the rotation speed of the electric motor may not reach a desired speed.

Therefore, in a rotation speed control region in which an output command is not more than a predetermined value, the electric motor is driven by rotation speed control. Accordingly, even when water lubrication in the fluid bearing is insufficient, the propeller is rotated at a desired speed, and a stable propulsive force is obtained even at the low speed. On the other hand, in a torque control region in which an output command is more than the predetermined value, sufficient water lubrication in the fluid bearing is secured, so that the electric motor is controlled using torque. Accordingly, the electric motor generates a torque corresponding to the output command, so that a propulsive force corresponding to the output command is obtained.

In a preferred embodiment of the present invention, the motor controller performs rotation speed keeping control to maintain a rotation speed of the electric motor so that the rotation speed of the electric motor is not less than a predetermined minimum rotation speed in the torque control region.

With this arrangement, in the torque control region, the rotation speed of the electric motor is kept at the minimum rotation speed or more. Accordingly, while a state is maintained in which water lubrication in the fluid bearing is not disturbed, a necessary torque is generated by the electric motor, and a propulsive force corresponding to the torque is generated by the propeller.

In a preferred embodiment of the present invention, the vessel propulsion apparatus includes a minimum rotation speed setter to be operated by a user to set the minimum rotation speed, and the motor controller performs the rotation speed keeping control based on a minimum rotation speed set by the minimum rotation speed setter in the torque control region.

With this arrangement, a user is able to set a minimum rotation speed, so that according to the user's preference and usage, the generation of a propulsive force particularly in a low-speed region is able to be adjusted.

A preferred embodiment of the present invention provides a vessel including a hull and a vessel propulsion apparatus including the features described above on the hull.

With this arrangement, even when an output command is low, stable rotation of the propeller is obtained, and in response to an output command more than the predetermined value, a propulsive force corresponding to the command is generated, so that an easy-to-operate vessel is obtained.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
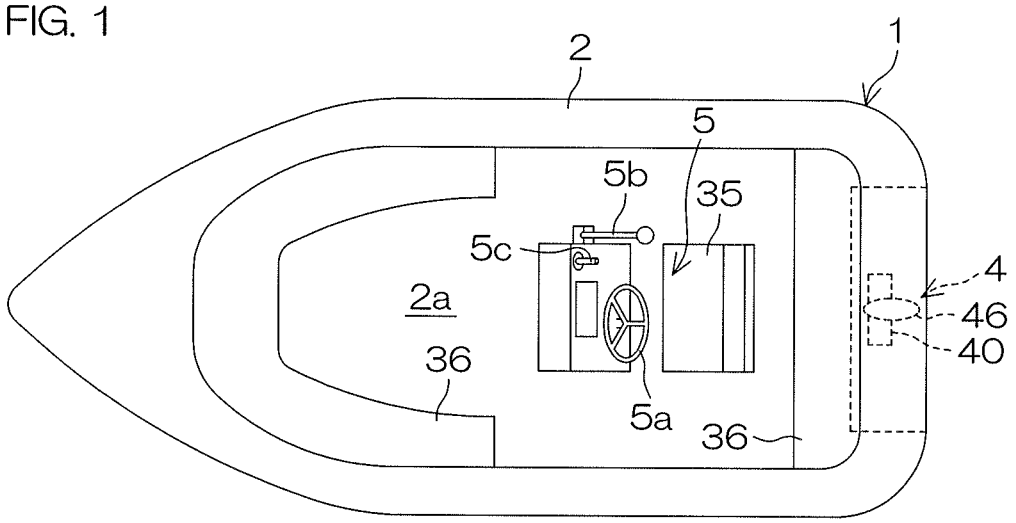
FIG. 1 is a schematic plan view to describe an example of a vessel according to a preferred embodiment of the present invention.
Figure 2:
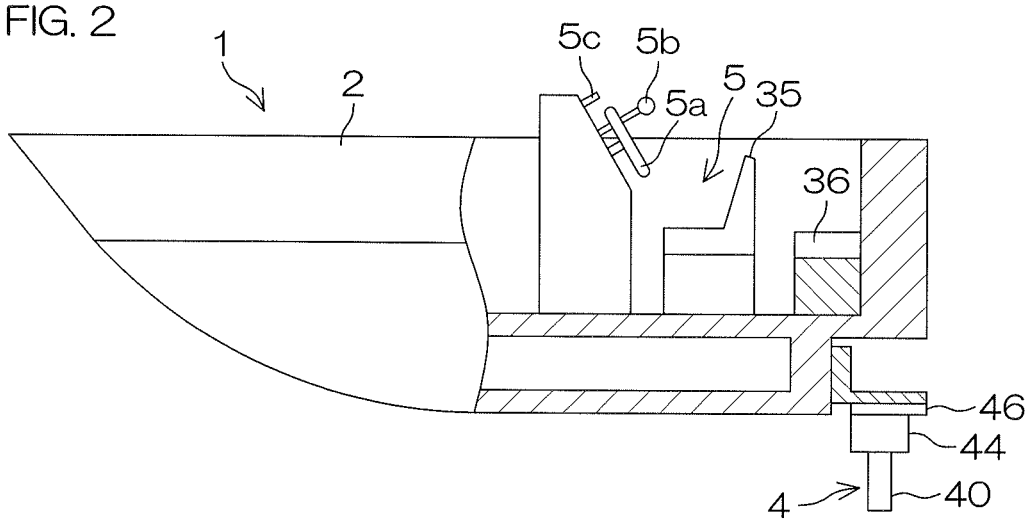
FIG. 2 is a side view partially showing a section of the vessel.

FIG. 1 is a schematic plan view to describe an example of a vessel 1 according to a preferred embodiment of the present invention, and FIG. 2 is a side view of the same, partially showing a section thereof. The vessel 1 includes a hull 2 and an electric propulsion unit 4 provided on the hull 2. A cockpit 5 is disposed inside a cabin 2*a* compartmented inside the hull 2. A steering wheel 5*a*, a shift lever 5*b*, and a joystick 5*c*, etc., are disposed in the cockpit 5. A vessel operator seat 35 is disposed in the cockpit 5. A seat 36 for occupants is disposed inside the cabin 2*a*.

Figure 3:
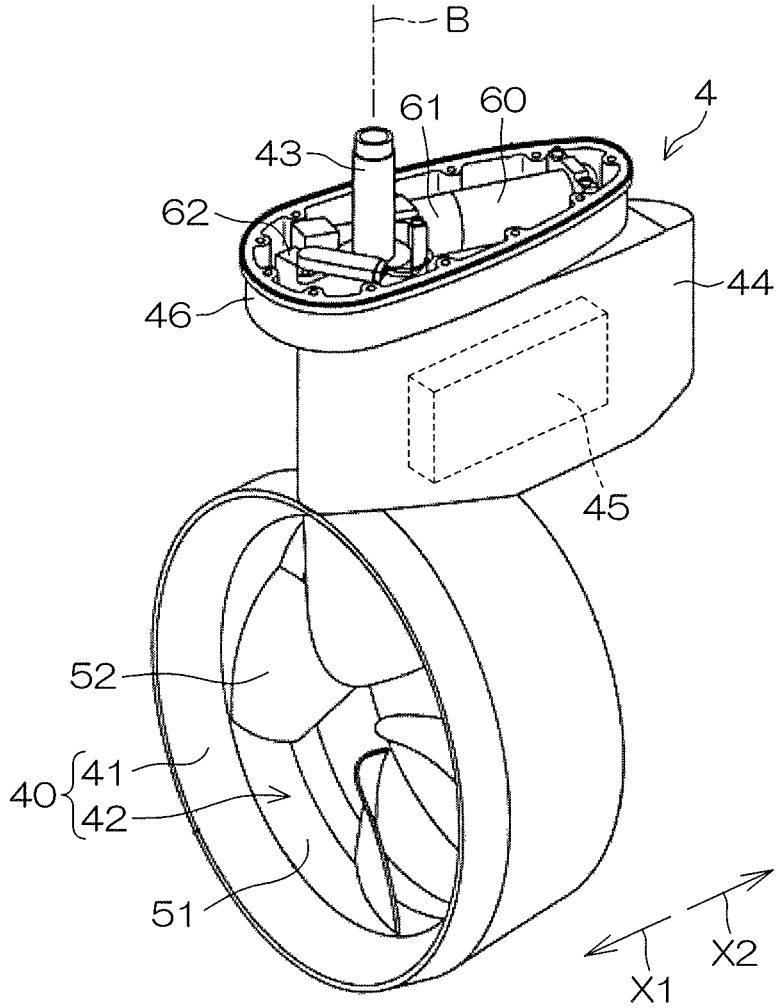
FIG. 3 is a perspective view to describe an example of an electric propulsion unit.
Figure 4:
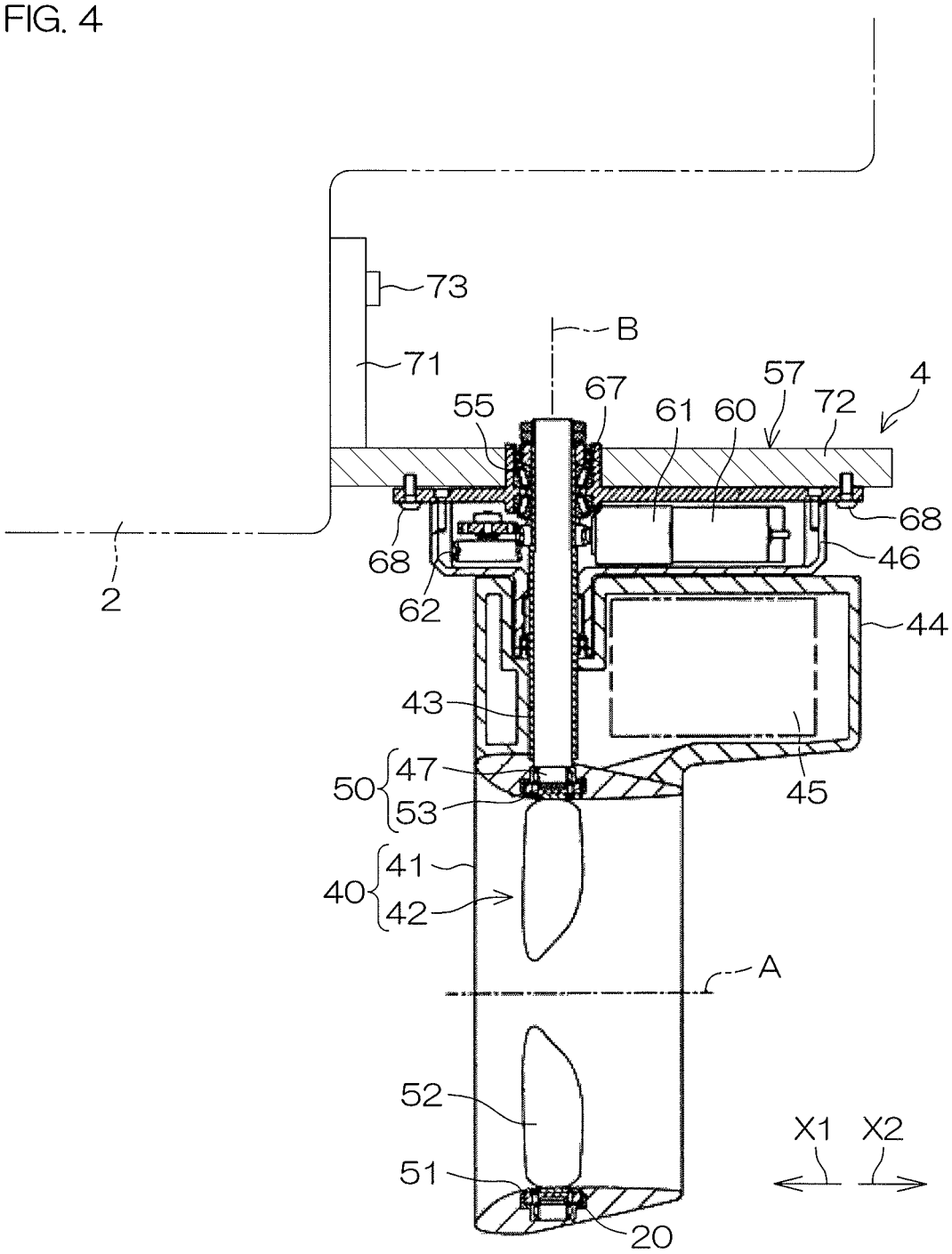
FIG. 4 is a longitudinal sectional view of the electric propulsion unit.

FIG. 3 is a perspective view to describe an example of the electric propulsion unit, and FIG. 4 is a longitudinal sectional view of the same. The electric propulsion unit 4 includes a cylindrical or substantially cylindrical duct 41, a propeller 42, a steering shaft 43, a casing 44, a motor controller 45, and a turning mechanism 46. The duct 41 includes a stator 47. The duct 41 and the propeller 42 define a propulsive force generator 40. The propulsive force generator 40 is turned around a steering shaft 43 by the turning mechanism 46. The propeller 42 includes a rim 51 and blades 52. The rim 51 includes a rotor 53. The stator 47 and the rotor 53 face each other, and these elements define an electric motor 50 (switched reluctance motor). That is, by applying a current to the stator 47, the rotor 53 rotates around a rotation axis A. As the electric motor 50, other than a switched reluctance motor (SR motor), a permanent magnet motor or a stepping motor may be used.

The duct 41 is a rotary body in which the rotation axis A is an axis of rotation, and its cross section in a plane including the rotation axis A is wing-shaped. That is, the cross section has a shape that is round at a front edge and pointed at a rear edge. An inner diameter (radius of an inner circumferential surface) of the duct 41 decreases toward the rear side in a region in front of the blades 52, and is almost uniform in a region from the blades 52 to the rear edge. An outer diameter (radius of an outer circumferential surface) of the duct 41 is almost uniform in the region in front of the blades 52, and decreases toward the rear side in the region from the blades 52 to the rear edge.

Figure 5:
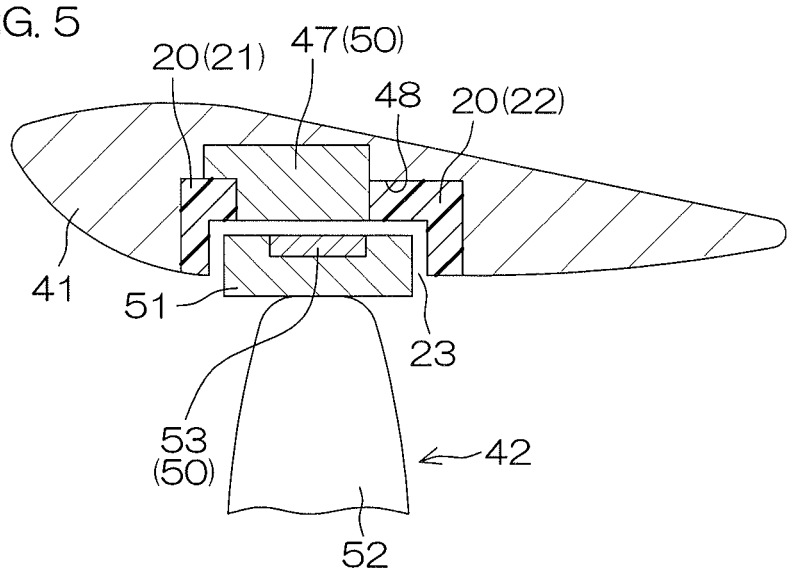
FIG. 5 is a sectional view of a duct provided in the electric propulsion unit.

As shown in the enlarged sectional view of FIG. 5, on the inner circumferential surface of the duct 41, a circumferential recess 48 recessed radially outward is provided. The rim 51 is housed in the recess 48. More specifically, the rim 51 is rotatably supported by the duct 41 via the fluid bearing 20 provided along the recess 48 of the duct 41.

On the outer circumference of the recess of the duct 41, the stator 47 is disposed. The stator 47 includes coils. The stator 47 generates a magnetic field when electric power is supplied to the coils. A plurality of coils are disposed circumferentially along the recess 48 of the duct 41. Electric power is respectively supplied to the plurality of coils in synchronization with rotation. Accordingly, a magnetic force of the stator 47 is applied to the rotor 53 of the propeller 42, and accordingly, the propeller 42 is rotated.

The fluid bearing 20 includes a front bearing 21 disposed at the front side of the stator 47 and a rear bearing 22 disposed at the rear side of the stator 47. Each of the front bearing 21 and the rear bearing 22 is preferably made from a resin, for example, is annular in shape and has an L-shaped cross section. The stator 47 is disposed between the front bearing 21 and the rear bearing 22, and the respective surfaces of the front bearing 21 and the rear bearing 22 are flush with an inner circumferential surface of the stator 47. The front bearing 21, the rear bearing 22, and the stator 47 define a U-shape surrounding the rim 51 along an inner surface of the recess 48. Accordingly, a gap 23 is defined between the rim 51 and the fluid bearing 20 and the stator 47. On the surfaces of the front bearing 21 and the rear bearing 22 facing the gap 23, grooves are provided through which surrounding water is introduced. When surrounding water enters the gap 23 and the rim 51 rotates, water flows through the inside of the gap 23. Accordingly, water lubrication between the rim 51 and the fluid bearing 20 is obtained, and the rim 51 is supported in a smoothly rotatable state by the duct 41.

The blades 52 of the propeller 42 are provided on the inner side of the ring-shaped rim 51, and radially outer edges of the blades are fixed to an inner circumferential surface of the rim 51. That is, the blades 52 project inward in the radial direction of the rim 51 from the inner circumferential surface of the rim 51. For example, four blades 52 are provided at even intervals (of about 90 degrees) along the circumferential direction. The blades 52 are preferably wing-shaped.

The rotor 53 is provided on the outer side of the rim 51. The rotor 53 faces the stator 47 of the duct 41. More specifically, the rotor 53 and the stator 47 face each other at a predetermined distance in the radial direction. That is, the electric motor 50 including the stator 47 and the rotor 53 is a radial gap type motor. In the rotor 53, a portion with high magnetic permeability and a portion with low magnetic permeability are alternately disposed circumferentially. That is, in the rotor 53, a reluctance torque is generated by a magnetic force generated from the stator 47. Accordingly, the rotor 53 (rim 51) is rotated.

As most clearly shown in FIG. 4, the steering shaft 43 turnably supports the duct 41. More specifically, the steering shaft 43 is supported rotatably by the turning mechanism 46 via a tapered roller bearing 55. The steering shaft 43 supports, via the tapered roller bearing 55, the casing 44 which is integral with the duct 41. The motor controller 45 is housed in the casing 44. The steering shaft 43 preferably has a hollow shape. Inside the hollow shape of the steering shaft 43, a wiring that supplies electric power to the stator 47, a wiring to connect the motor controller 45 and a battery (not shown) equipped in the hull 2, a wiring to connect an inboard LAN (Local Area Network) 91 (refer to FIG. 7) and the motor controller 45, and a wiring to connect the motor controller 45 and the turning mechanism 46, etc., are housed.

In the present preferred embodiment, the casing 44 is fixed to the duct 41 and turns together with the duct 41. More specifically, the casing 44 is integral with the duct 41. The casing 44 preferably has a streamlined shape along the rotation axis A of the propeller 42. More specifically, the casing 44 preferably has a streamlined shape so that its resistance to water relatively flowing in the direction X along the rotation axis A is small. In greater detail, the duct 41 and the casing 44 are preferably wing-shaped in cross section. Therefore, the duct 41 and the casing 44 generate a propulsive force by a wing effect when a water flow in a direction X2 from the front edge to the rear edge of the duct 41 is generated. On the other hand, the duct 41 and the casing 44 are arranged to, when a water flow in a reverse direction X1 is generated, hardly generate a propulsive force attributable to this water flow. This causes a difference between a propulsive force (forward-traveling propulsive force) in the direction X1 generated by rotating the propeller 42 forward and a propulsive force (backward-traveling propulsive force) in the direction X2 generated by reversely rotating the propeller 42 even though the rotation speed is the same. That is, the propulsive force (forward-traveling propulsive force) in the direction X1 is greater.

The turning mechanism 46 is disposed above the duct 41 and turns the duct 41. The turning mechanism 46 includes an electric motor 60, a reducer 61, and a turning angle sensor 62. The electric motor 60 of the turning mechanism 46 is driven based on a command from a controller 90 (refer to FIG. 7). The electric motor 60 is driven to rotate when supplied with electric power from a battery (not shown) equipped in the hull 2 via a driver. The electric motor 60 rotates the steering shaft 43 around a turning axis B via the reducer 61. The turning angle sensor 62 detects a rotational movement angle of the steering shaft 43 as a turning angle. Based on a detected turning angle, the electric motor 60 is feedback-controlled.

Figure 6:
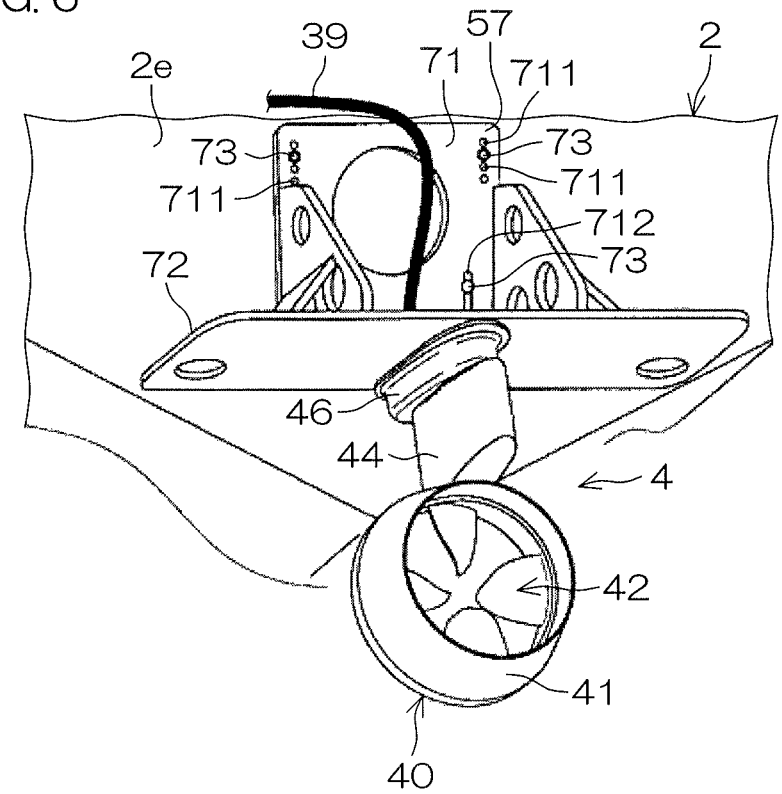
FIG. 6 is a perspective view showing an example of structure that attaches the electric propulsion unit to a hull.

FIG. 6 is a perspective view showing an example of structure that attaches the electric propulsion unit 4 to the hull 2. The electric propulsion unit 4 is attached to the hull 2 via a bracket 57. The bracket 57 supports the electric propulsion unit 4, and is attached to the rear side of the hull 2. The bracket 57 includes a hull attachment 71 and a propulsion unit attachment 72. The hull attachment 71 preferably has a tabular shape. The hull attachment 71 is attached to a transom at the rear side of the hull 2. The propulsion unit attachment 72 defines a predetermined angle with the hull attachment 71 and is integral with the hull attachment 71. The propulsion unit attachment 72 preferably has a tabular shape along a substantially horizontal direction. To the propulsion unit attachment 72, the electric propulsion unit 4 is attached. More specifically, an upper surface of the turning mechanism 46 is fixed to the propulsion unit attachment 72 of the bracket 57.

Near the center of the propulsion unit attachment 72, an attaching hole 67 (refer to FIG. 4) through which a steering shaft 43 of the electric propulsion unit 4 is inserted is provided. In a state where the portion of the steering shaft 43 is inserted through the attaching hole 67, the turning mechanism 46 is fixed to a lower surface of the propulsion unit attachment 72 by bolts 68, for example (refer to FIG. 4).

Near right and left edge portions of the hull attachment 71, rows each including a plurality of holes 711 are respectively provided, and on the lower sides of these, a pair of slots 712 extending vertically are respectively provided. Bolts 73 are respectively inserted through the holes 711 and the slots 712, and the bolts 73 are coupled to a transom plate 2*e* of the hull 2. Accordingly, the bracket 57 is fixed to the hull 2. Into the steering shaft 43, wirings 39 are inserted. The wirings 39 are led to the hull 2 and connected to the battery (not shown) and the controller 90 (refer to FIG. 7), etc., disposed inside the hull 2.

Figure 7:
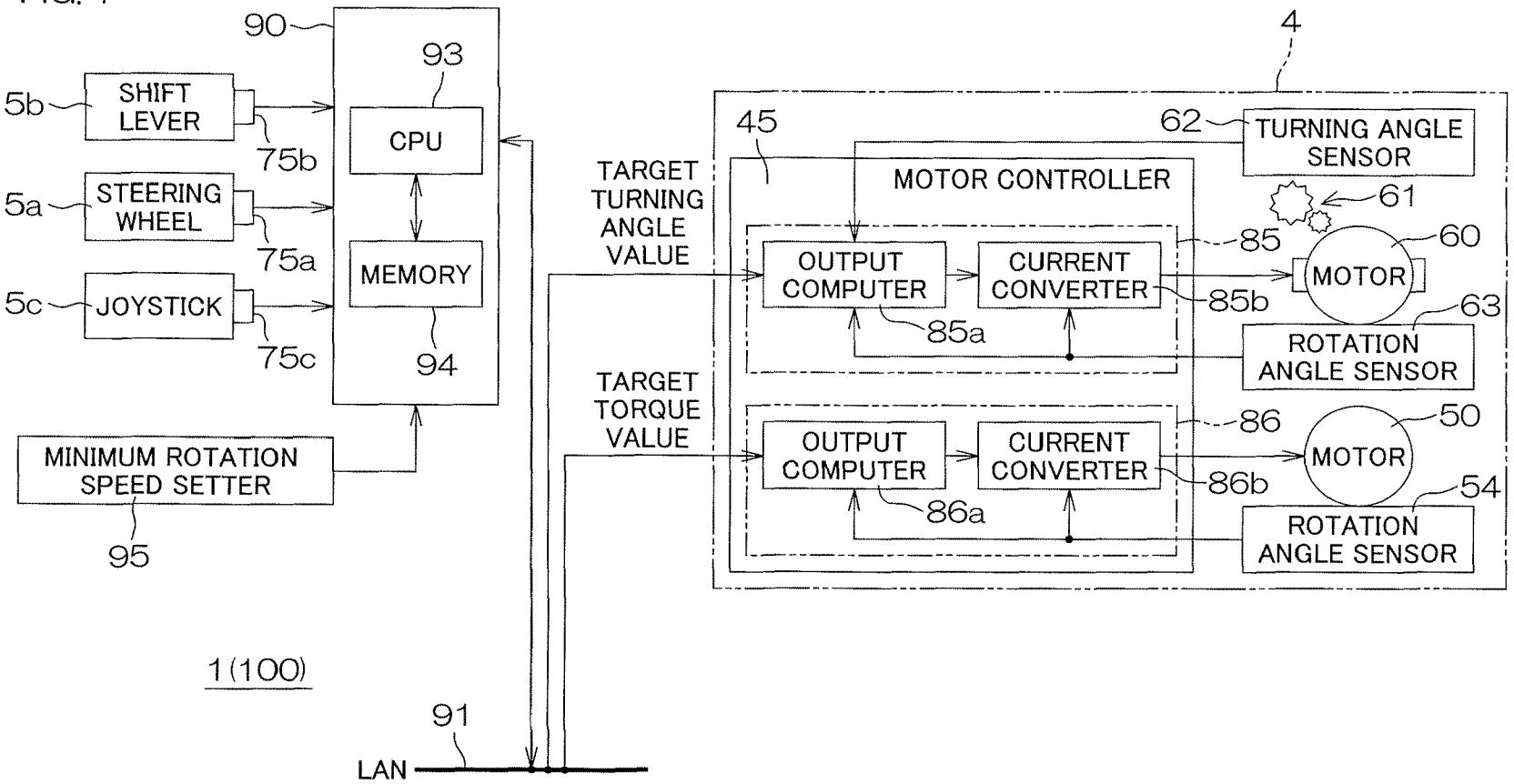
FIG. 7 is a block diagram to describe an electrical configuration of the vessel.

FIG. 7 is a block diagram to describe an electrical configuration of the vessel. The vessel 1 includes the controller 90. The controller 90 and the electric propulsion unit 4 define a vessel propulsion apparatus 100 according to a preferred embodiment of the present invention. Input signals from the steering wheel 5*a*, the shift lever 5*b*, and the joystick 5*c* are input into the controller 90. More specifically, in relation to the steering wheel 5*a*, an operation angle sensor 75*a* that detects an operation angle of the steering wheel 5*a* is provided. In addition, in relation to the shift lever 5*b*, an accelerator openingdegree sensor 75*b* including a position sensor that detects an operation position (operation amount) of the shift lever 5*b* is provided. Further, in relation to the joystick 5*c*, a joystick position sensor 75*c* including a position sensor that detects an operation position of the joystick 5*c* is provided. Detection signals of these sensors 75*a*, 75*b*, and 75*c* are input into the controller 90.

The controller 90 is connected to the inboard LAN 91. The turning mechanism 46 of the electric propulsion unit 4 includes, as described above, an electric motor 60 (hereinafter, referred to as a "turning motor 60") as a drive source. The electric motor 50 (hereinafter, referred to as a "propulsion motor 50") that rotationally drives the propeller 42, and the turning motor 60 are actuated by a drive current supplied from the motor controller 45. The motor controller 45 of each of the electric propulsion units 4R and 4L is connected to the inboard LAN 91. The controller 90 communicates with the motor controller 45 via the inboard LAN 91 and provides a drive command value to the motor controller 45.

The motor controller 45 includes a turning motor controller 85 to drive the turning motor 60 and a propulsion motor controller 86 to drive the propulsion motor 50.

The turning motor controller 85 includes an output computer 85*a* and a current converter 85*b*. Into the output computer 85*a*, a target turning angle value, an actual turning angle value, and a motor rotation angle are input. The target turning angle value is output from the controller 90 via the inboard LAN 91. The actual turning angle value is detected by the turning angle sensor 62 equipped in the turning mechanism 30. The motor rotation angle is detected by a rotation angle sensor 63 attached to the turning motor 60. The rotation angle sensor 63 detects a rotation angle of a rotor of the turning motor 60. The output computer 85*a* generates an output torque value based on a deviation between the target turning angle value and the actual turning angle value, and a motor rotation angle detected by the rotation angle sensor 63, and supplies the output torque value to the current converter 85*b*. The current converter 85*b* supplies a drive current corresponding to the output torque value to the turning motor 60. Thus, the turning motor 60 is driven. The turning motor 60 is accordingly feedback-controlled so that the actual turning angle approaches the target turning angle value.

The propulsion motor controller 86 is an example of a motor controller, and includes an output computer 86*a* and a current converter 86*b*. Into the output computer 86*a*, a target torque value is input, and a motor rotation angle is input. The target torque value is output from the controller 90 via the inboard LAN 91. The motor rotation angle is detected by the rotation angle sensor 54 attached to the propulsion motor 50. The rotation angle sensor 54 detects a rotation angle of a rotor 53 of the propulsion motor 50. Instead of a rotation angle sensor 54, it is also possible that a rotation angle of the propulsion motor 50 is obtained by internal computing by the motor controller 45. The output computer 86*a* generates an output torque value based on the target torque value and the motor rotation angle, and supplies the output torque value to the current converter 86*b*. The current converter 86*b* supplies a drive current corresponding to the output torque value to the propulsion motor 50, and thus, the propulsion motor 50 is driven. Accordingly, the propulsion motor 50 is controlled so that the target torque value is reached, and accordingly, a propulsive force satisfying a requested output is obtained. The target torque value is a positive or negative value. When the target torque value is a positive value, the propulsion motor 50 is driven in a forward rotation direction. When the target torque value is a negative value, the propulsion motor 50 is a driven in a reverse rotation direction. That is, the propulsion motor controller 86 drives the propulsion motor 50 in the forward rotation direction and the reverse rotation direction.

The motor controller 45 transmits output torque values operated by the output computers 85*a* and 86*a* and an actual turning angle value to the controller 90 via the inboard LAN 91.

Into the controller 90, shift lever position information (an output of the accelerator openingdegree sensor 75*b*) showing an operation position of the shift lever 5*b* is input. The shift lever 5*b* is an operating element to be operated by an operator to select forward traveling, stop, or backward traveling (shift position), and set an accelerator opening degree (accelerator operation amount). An operation amount of the shift lever 5*b* is detected by the accelerator opening degree sensor 75*b*. Therefore, the controller 90 interprets output signals of the accelerator opening degree sensor 75*b* as shift lever position information and accelerator opening degree information. Into the controller 90, operation angle information of the steering wheel 5*a* (an output of the operation angle sensor 75*a*) is input. Operation position information of the joystick 5*c* (an output of the joystick position sensor 75*c*) is also input into the controller 90. The joystick 5*c* is an example of an accelerator (accelerator operator, accelerator lever). An operation position of the joystick 5*c* is detected by the joystick position sensor 75*c*. The controller 90 interprets output signals of the joystick position sensor 75*c* as a steering command signal and an accelerator command signal (accelerator opening degree), etc.

Into the controller 90, various pieces of information are further input from the inboard LAN 91. More specifically, as information relating to the electric propulsion unit 4, output torque values and actual turning angle values, etc., are input into the controller 90.

The controller 90 outputs, as described above, target turning angle values, target torque values, and target storing angle values in relation to the electric propulsion unit 4.

In a preferred embodiment of the present invention, the controller 90 is programmed to drive the propulsion motor 50 by rotation speed control when the accelerator opening degree (output command) is not more than a predetermined value, and drives the propulsion motor 50 by torque control when the accelerator opening degree is more than the predetermined value. The controller 90 includes a CPU (Central Processing Unit) 93 and a memory 94 storing programs to be executed by the CPU 93. By executing the programs with the CPU 93, the controller 90 performs functions as a plurality of functional processors. One of the functions is switching of a control method of the propulsion motor 50 according to an accelerator opening degree.

Figure 8A:
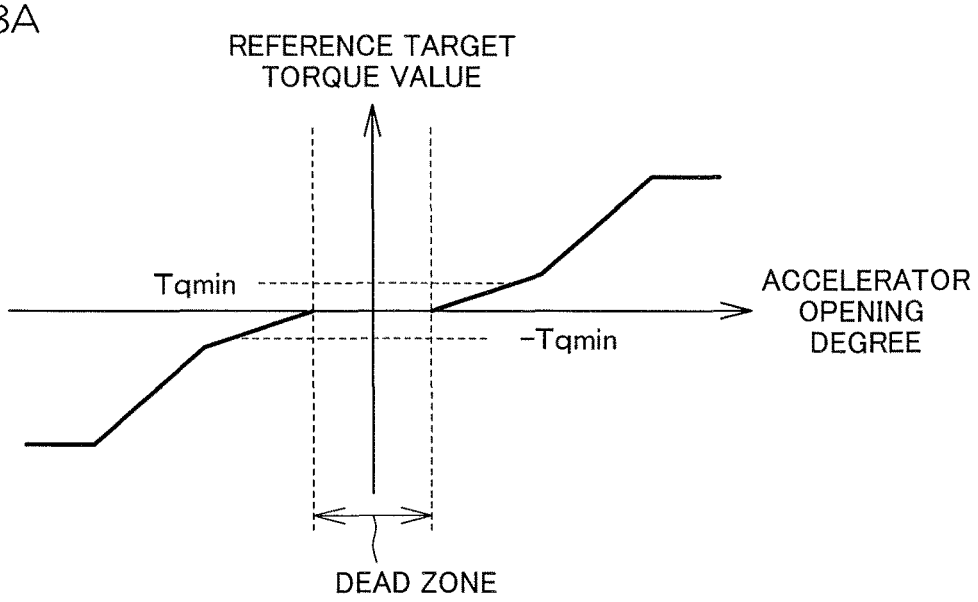
FIGS. 8A and 8B are characteristic diagrams to describe examples of control characteristics of an electric motor.
Figure 8B:
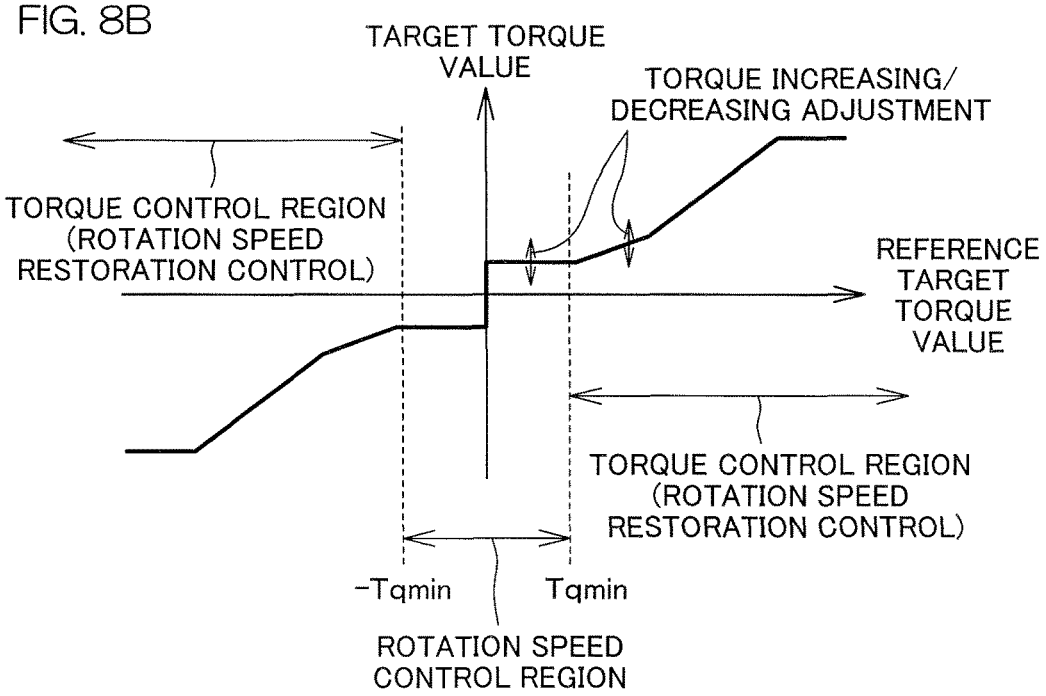

FIGS. 8A and 8B are diagrams to describe control characteristics of the propulsion motor 50 by the controller 90. FIG. 8A shows a characteristic example of a reference target torque value with respect to an accelerator opening degree (output command). FIG. 8B shows a characteristic example of a target torque value obtained by correcting the reference target torque value.

As seen in FIG. 8A, a region in which the accelerator opening degree is positive is a region in which the shift lever 5*b* or the joystick 5*c* is tilted forward and generation of a propulsive force in a forward-traveling direction is requested. In this region, when the accelerator opening degree exceeds a dead zone set near zero, a positive target torque value is set so that the torque smoothly increases to an upper limit value. In this case, the propulsion motor 50 is rotated in the forward rotation direction.

On the other hand, a region in which the accelerator opening degree is negative is a region in which the shift lever 5*b* or the joystick 5*c* is tilted rearward and generation of a propulsive force in a backward-traveling direction is requested. In this region, when the accelerator opening degree decreases beyond the dead zone set near zero, a negative target torque value is set so that the torque smoothly decreases to a lower limit value. In this case, the propulsion motor 50 is rotated in a reverse rotation direction.

In a preferred embodiment of the present invention, as shown in FIG. 8B, by correcting the reference target torque value, a target torque value is obtained. A rotation speed control region is set in a region in which an absolute value of the reference target torque value Tq* is not more than an output torque lower limit value Tqmin (>0). Based on the reference target torque value characteristics shown in FIG. 8A, the rotation speed control region corresponds to a region in which an absolute value of the accelerator opening degree is comparatively small, that is, the output command value is small. In this rotation speed control region, the controller 90 performs rotation speed control for the propulsion motor 50. In a region in which an absolute value of the reference target torque value is larger than the rotation speed control region, the controller 90 performs torque control for the propulsion motor 50. That is, a torque control region is set to a region out of (larger in absolute value than) the rotation speed control region.

Characteristics of the target torque value in the torque control region follow the reference target torque value characteristics (refer to FIG. 8A), in principle. However, when the rotation speed of the propulsion motor 50 is below the predetermined lower limit, rotation speed restoration control is performed to correct the reference target torque value. Therefore, the torque control region is a region in which the rotation speed restoration control is able to be entered.

In the rotation speed control region, the reference target torque value characteristics are corrected, and a target torque value whose absolute value is larger than the reference target torque value is set so that a necessary rotation speed is secured.

Figure 9:
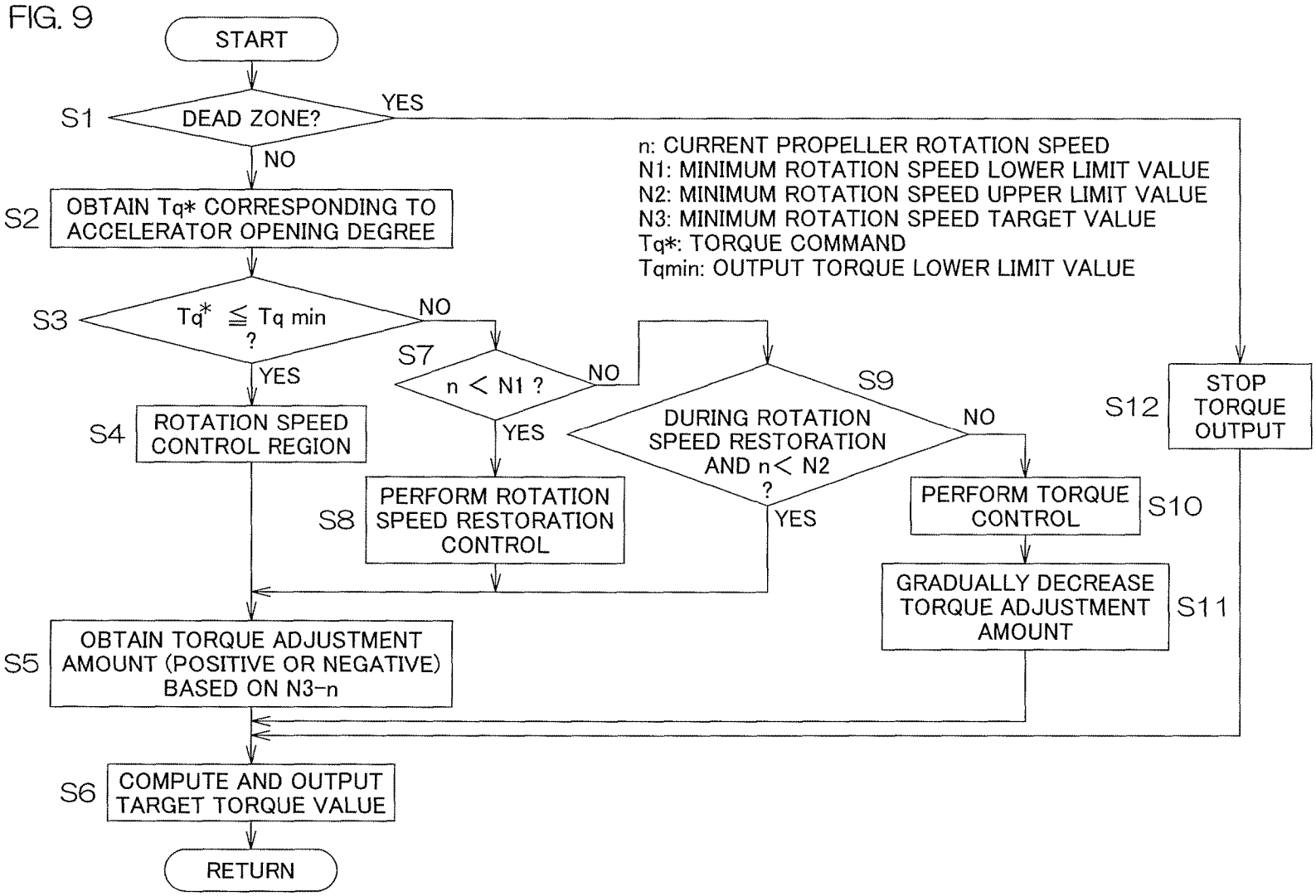
FIG. 9 is a flowchart to describe an example of a process to control the electric motor.

FIG. 9 is a flowchart to describe an example of a process to be repeatedly performed by the controller 90 to control the propulsion motor 50. The controller 90 judges whether the accelerator opening degree is in the dead zone, and when it is in the dead zone (Step S1: YES), commands the motor controller 45 to stop the torque output (Step S12), that is, stop the propulsion motor 50. When the accelerator opening degree is at a value out of the dead zone (Step S1: NO), the controller 90 obtains a reference target torque value Tq* corresponding to the accelerator opening degree according to the reference target torque value characteristics (refer to FIG. 8A) (Step S2). When this reference target torque value Tq* is not more than the output torque lower limit value Tqmin (Step S3: YES), the controller 90 determines that the current state is in the rotation speed control region (Step S4). Then, the controller 90 obtains a torque adjustment amount based on a difference (N3−n) between a current rotation speed of the propulsion motor 50, that is, a current rotation speed n of the propeller 42 (hereinafter, referred to as the "propeller rotation speed n") and a minimum target rotation speed N3 (Step S5). The current propeller rotation speed n may be acquired from the motor controller 45 via the inboard LAN 91. Based on the thus obtained torque adjustment amount, the reference target torque value is adjusted to obtain a target torque value, and this target torque value is provided to the motor controller 45 (Step S6). Thus, the rotation speed control (Steps S5 and S6) is performed.

When this reference target torque value Tq* is more than the output torque lower limit value Tqmin (Step S3: NO), the controller 90 further judges whether the current propeller rotation speed n is less than the minimum rotation speed lower limit value N1 (≥N3) (Step S7). When the result of this judgment is affirmative, the controller 90 determines that the rotation speed restoration control (rotation speed keeping control) should be performed due to the low propeller rotation speed n although the current state is in the torque control region (Step S8). Then, in order to increase the rotation speed, the controller 90 performs the rotation speed restoration control by performing the processes of Steps S5 and S6.

When the current propeller rotation speed n is not less than the minimum rotation speed lower limit value N1 (Step S7: NO), the controller 90 further judges whether the rotation speed restoration control is being performed and the propeller rotation speed n is less than the minimum rotation speed upper limit N2 (≤N1) (Step S9). When the result of this judgment is affirmative, the rotation speed restoration control (Steps S5 and S6) is continuously performed. On the other hand, when the result of the judgment is negative, the controller 90 judges that the current state is in the torque control region and the propeller rotation speed n is sufficiently high, and judges that the torque control should be performed (Step S10). Then, the controller 90 gradually decreases (gradually decreases the absolute value of) a torque adjustment amount (increasing/decreasing amount) integrated for rotation speed adjustment to make the target torque value closer to the reference target torque value (Step S11). The controller 90 provides this target torque value to the motor controller 45 (Step S6).

In the electric propulsion unit 4 of the present preferred embodiment, by supplying a current to the stator 47 provided on the duct 41, the rim 51 rotates together with the rotor 53. Accordingly, blades 52 provided on the inner side in the radial direction of the rim 51 paddle the surrounding water, so that a propulsive force is generated. A gap 23 is defined between the fluid bearing 20 provided on the duct 41 and the rim 51. Due to water introduced into the gap 23 from the surroundings, water lubrication between the rim 51 and the fluid bearing 20 is obtained. Accordingly, the rim 51 is supported rotatably by an inexpensive arrangement.

When a rotation speed of the rim 51, that is, a rotation speed of the propeller 42 is low, the water flow inside the gap 23 between the fluid bearing 20 and the rim 51 is not sufficient, so that the rim 51 may come into frictional contact with the fluid bearing 20. Due to this, the rotation speed of the propulsion motor 50 may not reach a desired speed.

Therefore, in a preferred embodiment of the present invention, in a rotation speed control region in which a reference target torque value Tq* (value corresponding to an accelerator opening degree) is not more than the output torque lower limit value Tqmin, the propulsion motor 50 is driven by rotation speed control (Steps S4 to S6). Accordingly, even when the water lubrication in the fluid bearing 20 is insufficient, the propeller 42 is able to be rotated at a desired speed, and a stable propulsive force is obtained even at a low speed. On the other hand, in a torque control region in which the reference target torque value Tq* is more than the output torque lower limit value Tqmin, sufficient water lubrication in the fluid bearing 20 is secured, so that the propulsion motor 50 is torque-controlled (Steps S10, S11, and S6). Accordingly, the propulsion motor 50 generates a torque corresponding to the accelerator opening degree (output command), so that a propulsive force corresponding to an intention of a vessel operator is obtained.

In addition, in a preferred embodiment of the present invention, in the torque control region, rotation speed restoration control (rotation speed keeping control) to maintain a rotation speed of the propulsion motor 50 is performed so that the rotation speed of the propeller 42 is not less than the minimum rotation speed lower limit value N1 (Steps S7, S8, S5, and S6). Accordingly, while a state is maintained in which the water lubrication in the fluid bearing 20 is not disturbed, a necessary torque is generated by the propulsion motor 50, and a propulsive force corresponding to the torque is generated by the propeller 42.

Thus, stable rotation of the propeller 42 is obtained even when the accelerator opening degree is small, and when the accelerator opening degree is sufficiently large, a propulsive force corresponding to an acceleration command from a vessel operator is generated, so that the vessel 1 is easy to operate.

Preferred embodiments of the present invention have been described above, and the present invention can also be carried out by other preferred embodiments. For example, as shown in FIG. 7, a minimum rotation speed setter 95 to be operated by a user to set a minimum rotation speed lower limit value N1 and/or a minimum rotation speed upper limit value N2 may be provided. Accordingly, a user is able to set a minimum rotation speed to be applied in the torque control region, so that generation of a propulsive force particularly in a low-speed region is adjusted according to the user's preference and usage.

In a preferred embodiment of the present invention described above, an arrangement in which the hull 2 is provided with one electric propulsion unit 4 is described. However, the hull 2 may be provided with two or more electric propulsion units 4.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. A vessel propulsion apparatus comprising:

a duct including a stator;

a propeller including a rim that includes a rotor facing the stator and defining an electric motor in combination with the stator, and a blade on an inner side in a radial direction of the rim;

a fluid bearing provided on the duct, and that defines a gap into which surrounding water is introduced between the fluid bearing and the rim, and is water-lubricated with respect to the rim due to water introduced into the gap from the surroundings; and a motor controller configured or programmed to drive the electric motor by rotation speed control in a rotation speed control region in which an output command is not more than a predetermined value, and drives the electric motor by torque control in a torque control region in which an output command is more than the predetermined value.

2. The vessel propulsion apparatus according to claim 1, wherein the motor controller is configured or programmed to perform rotation speed keeping control to maintain a rotation speed of the electric motor so that the rotation speed of the electric motor is not less than a minimum rotation speed in the torque control region.

3. The vessel propulsion apparatus according to claim 2, further comprising:

a minimum rotation speed setter to be operated by a user to set the minimum rotation speed; wherein the motor controller is configured or programmed to perform the rotation speed keeping control based on the minimum rotation speed set by the minimum rotation speed setter in the torque control region.

4. A vessel comprising:

a hull; and a vessel propulsion apparatus on the hull, the vessel propulsion apparatus including:

a duct including a stator;

a propeller including a rim that includes a rotor facing the stator and defining an electric motor in combination with the stator, and a blade on an inner side in a radial direction of the rim;

a fluid bearing provided on the duct, and that defines a gap into which surrounding water is introduced between the fluid bearing and the rim, and is water-lubricated with respect to the rim due to water introduced into the gap from the surroundings; and a motor controller configured or programmed to drive the electric motor by rotation speed control in a rotation speed control region in which an output command is not more than a predetermined value, and drives the electric motor by torque control in a torque control region in which the output command is more than the predetermined value.

5. The vessel according to claim 4, wherein the motor controller is configured or programmed to perform rotation speed keeping control to maintain a rotation speed of the electric motor so that the rotation speed of the electric motor is not less than a minimum rotation speed in the torque control region.

6. The vessel according to claim 5, further comprising:

a minimum rotation speed setter to be operated by a user to set the minimum rotation speed; wherein the motor controller is configured or programmed to perform the rotation speed keeping control based on the minimum rotation speed set by the minimum rotation speed setter in the torque control region.

* * * * *